United States Patent [19]

Eschmann

[11] Patent Number: 4,775,446

[45] Date of Patent: Oct. 4, 1988

[54] SEAM FOR A PAPERMAKING MACHINE SCREEN OR FELT

[75] Inventor: Sylvester Eschmann, Mönchengladbach, Fed. Rep. of Germany

[73] Assignee: Thomas Josef Heimbach GmbH & Co., Duren, Fed. Rep. of Germany

[21] Appl. No.: 95,217

[22] Filed: Sep. 11, 1987

[30] Foreign Application Priority Data

Oct. 1, 1986 [DE] Fed. Rep. of Germany ..... 3633395

[51] Int. Cl.[4] ..... D21F 7/10; D21F 1/12

[52] U.S. Cl. ..... 162/348; 139/383 A; 162/358; 162/DIG. 1; 24/33 P

[58] Field of Search ..... 162/DIG. 1, 348, 358; 139/383 A, 383 AA, 408–415, 425 A; 245/10; 24/33 R, 33 P

[56] References Cited

U.S. PATENT DOCUMENTS

| | | | |
|---|---|---|---|
| 4,103,717 | 8/1978 | Clark | 162/DIG. 1 |
| 4,123,022 | 10/1978 | Dutt et al. | 139/383 AA |
| 4,141,388 | 2/1979 | Romanski et al. | 162/DIG. 1 |
| 4,186,780 | 2/1980 | Josef et al. | 162/DIG. 1 |
| 4,206,787 | 6/1980 | Strandly | 139/383 AA |
| 4,658,863 | 4/1987 | Errerart | 139/383 A |

FOREIGN PATENT DOCUMENTS

| | | | |
|---|---|---|---|
| 0198773 | 10/1986 | European Pat. Off. | 139/383 A |

*Primary Examiner*—Kenneth M. Schor
*Assistant Examiner*—K. M. Hastings
*Attorney, Agent, or Firm*—Shlesinger, Arkwright & Garvey

[57] ABSTRACT

A joinable paper machine felt assembly includes a plurality of spaced first and second cross-threads, the cross-threads being longitudinally spaced and each first cross-thread being laterally spaced from a second cross-thread for thereby defining a plurality of cross-thread pairs. An end two of the cross-thread pairs define first and second fabric ends. A plurality of first and second alternatingly disposed and directly adjacently positioned lengthwise threads bind the cross-threads into a fabric. Each first lengthwise thread forms a first loop extending over the threads of the cross-thread pair at one of the fabric ends and immediately thereafter each first lengthwise thread extends back into the fabric and alternatingly first crossing between and then passing over the associated cross-threads of the cross-thread pairs. Each second lengthwise thread forms a seam loop extending beyond one of the fabric ends and thereafter each second lengthwise thread extends back into the fabric and between but not being crossed between the cross-threads of the cross-thread pair at the associated end and immediately thereafter alternatingly first passing over and then crossing between the associated cross-threads of the cross-thread pairs. The seam loops are aligned in order to permit receipt of a slip-in joining means.

8 Claims, 1 Drawing Sheet

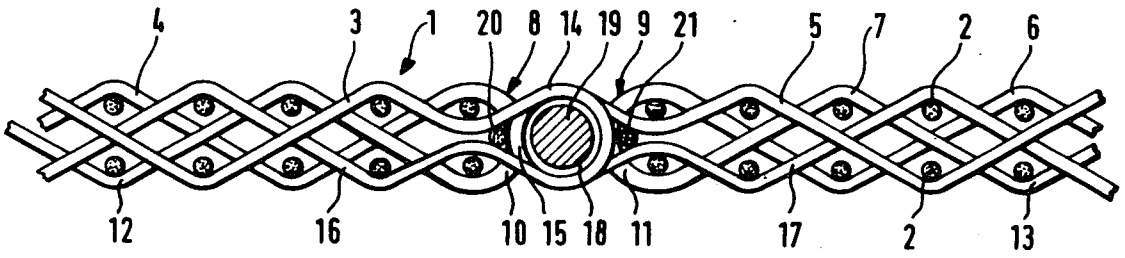
4
3
1
20
8
14
19
9
21
5
7
2
6
12
16
10
15
18
11
17
2
13

SEAM FOR A PAPERMAKING MACHINE SCREEN OR FELT

The invention concerns a machine covering, in particular a screen or felt for a papermaking machine, with a flat, at least two-ply fabric. The lengthwise threads bind the plies which consists of cross-threads and the lengthwise threads form elbows. The lengthwise threads are woven back into the fabric at the front and rear fabric edges to form loops. Part of the loops form seam loops projecting beyond the fabric edges for a slip-in wire seam connection.

Frequently, flat fabrics having two or more plies are used as papermaking machine coverings. Such flat fabrics are characterized by the individual plies being formed essentially by the cross-threads and by each lengthwise thread binding cross-threads, from all plies while also forming elbows. Such a flat fabric is shown in U.S. Pat. No. 4,141,388 as a support fabric for a drier felt fabric.

In these flat fabrics, the two fabric edges transverse to the lengthwise threads are formed in such a manner that these lengthwise threads are woven back into the fabric while subtending loops. The weaving back being into the plane of an adjacent lengthwise thread sufficiently shortened to impinge by its end on the tip of the woven-back segment of lengthwise thread. The woven-back segment of the lengthwise thread is so bound thereby that it extends the fabric-binding of the shortened lengthwise thread as far as the fabric edge.

Some of the loops are formed in such a manner that they project substantially beyond the fabric edges. They then form the seam loops for a slip-in wire seam connector. For that purpose, the seam loops of one fabric edge are mounted in such a way relative to the other edge that, when the fabric edges are joined, the loops will overlap in meshing manner, whereby they form a channel to pass through a slip-in wire. The slip-in wire then forms the connection of the two fabric edges, and accordingly an endless machine covering is achieved.

In the flat-woven fabrics known heretofore, the seam loops are Closed toward the fabric edge because the lengthwise threads forming the seam loops again cross in the vicinity of the fabric edge. This crossing follows from the continuation of the fabric pattern to the fabric edge.

In this design, when the seam loops are stressed, they will very tiqhtly close around the slip-in wire and, as a result, the force transmission into the fabric geometry is disadvantageous. Furthermore, it is exceedingly difficult to insert the slip-in wire when assembly takes place under tension.

The object of the invention is to so design the seam loops of a machine covering of the initially described kind that more advantageous force transmission into the fabric takes place and that assembly under tension shall be facilitated.

The invention solves this problem in that all the seam loops assume a U-shape and are open toward the fabric edges.

In the invention, those lengthwise threads forming the seam loops are so controlled in the vicinity of the fabric edges that they no longer cross each other but, instead, substantially project from or enter the fabric in straight manner. Thereby, the seam loop is open toward the fabric edge, and cannot close even under high tension. Accordingly, the forces exerted are better transmitted into the fabric and are better distributed therein. Even in the presence of tension, the slip-in wire can be introduced in relatively simple manner, because the loop also remains open in the presence of that tension.

In the implementation of the invention, those lengthwise threads forming the seam loops project from the insides of cross-threads beyond the fabric edge and reenter same. This control, which is known per se, of the lengthwise threads is particularly advantageous in the design of the invention of the seam loops because the particular last crossing of the lengthwise threads takes place especially far from the fabric edge, and thereby wide-open seam loops are created. The cross-threads at the fabric edge offer only slight impedance when pressed apart while the seam loops undergo tension.

Moreover, the shape of the seam loop of the invention offers the possibility of using additional filler threads. Thereby the permeability in the vicinity of the seam can be matched to that elsewhere in the machine covering. To provide a firm fixation to those filler threads, they should be bound by part of the loops forming the fabric edges, while the other part will not bind the filler threads and thereby presses them into the seam loop.

Lastly, the invention provides that the ends of the lengthwise threads are woven back in such a manner that they continue with the binding action on the adjacent lengthwise threads. By means of this control—known per se—of the lengthwise threads, an especially good force transmission from the lengthwise threads forming the seam loops into the fabric will be achieved.

The drawing illustrates more closely the invention in relation to an embodiment. It shows a longitudinal section in the vicinity of the seam of a double-ply papermakinq machine fabric (1), which is suited especially well as a support fabric for a seamed pressing felt. In this application, a web is placed on the upper side of the papermaking machine fabric (1), and this web then is pinned or needled into the papermaking machine fabric (1).

The papermaking machine fabric (1) consists of two plies of monofilar cross-threads—illustratively denoted by (2)—and of lengthwise threads of which only two (3, 4) and (5, 6) are respectively shown on each side in the drawing. All the lengthwise threads (3, 4, 5, 6) bind the cross-threads (2) by elbows illustratively denoted by (7), each lengthwise thread (3, 4, 5, 6) following the binding of a cross-thread (2) in the lower ply binding a cross-thread (2) in the upper ply. Accordingly, the papermaking machine fabric (1) is manufactured as a flat fabric.

In the vicinity of the fabric edges (8, 9), the plurality of lengthwise threads (4,6) form narrow loops 10, 11), and then are woven back into the papermaking machine fabric. The woven-back segments (12, 13) then run along a mirror-image course relative to the binding of the associated lengthwise threads (4, 6). The woven-back segments (12, 13) end in the zones not shown herein. There they impinge on the shortened end of an adjacent lengthwise thread.

Part of the lengthwise threads (3, 5) form seam loops (14, 15) projecting beyond the fabric edges (8, 9). By both their projecting and woven-back segments (16, 17) they always pass by the last pair of cross-threads (2) at the inside and thereupon they diverge again without crossing one another. In the embodiment shown, the seam loops (14, 15) of both fabric edges (8, 9) are made to overlap in meshing manner, whereby a channel (18) parallel to the fabric edges (8, 9) is generated, through which the slip-in wire (19) is passed to act as coupling. The slip-in, (19) closes the seam.

Because of the special guidance control, the seam loops (14, 15) are open toward the fabric edges (8, 9). When under tension, the two pairs of cross-threads (2) at the fabric edges (8, 9) are pressed apart, whereby the legs of the seam loops (14, 15) move straight into and out of the fabric. Because the lengthwise threads (3, 5) bind the particular pair of following cross-threads (2) at the outside, the seam loops (14, 15) remain open toward the particular fabric edges (8, 9), even under strong tension. Furthermore, the woven-back segments (16, 17) of the lengthwise threads (3, 5) forming the seam loops (14, 15) are guided correspondingly in the manner of the woven-back segments (12, 13) of the lengthwise threads (4, 6).

Moreover, a filler thread (20, 21) is inserted in the seam loops (14, 15). The filler threads (20, 21) are bound by the loops (10, 11) of the lengthwise threads (4, 6). Further but omitted lengthwise threads pass between the particular last pair of cross-threads (2) and the filler threads (20, 21) during loop formation, whereby the fillers (20, 21) are pressed toward the slip-in wire (19). They are fixed in position in this way.

I claim:

1. A joinable paper machine felt assembly, comprising:

(a) a plurality of spaced first and second cross-threads, said cross-threads are longitudinally spaced and each first cross-thread is laterally spaced from a second cross-thread for thereby defining a plurality of cross-thread pairs;

(b) an end two of said cross-thread pairs define first and second fabric ends;

(c) a plurality of first and second alternatingly disposed and directly adjacently positioned lengthwise threads bind said cross-threads into a fabric;

(d) each first lengthwise thread forming a first loop extending over the threads of the cross-thread pair at one of the fabric ends and immediately thereafter each first lengthwise thread extending back into the fabric and alternatingly first crossing between and then passing over the associated cross-threads of said cross-thread pairs;

(e) each second lengthwise thread forming a seam loop extending beyond one of the fabric ends and thereafter each second lengthwise thread extending back into the fabric and between but not being crossed between the cross-threads of the cross-thread pair at the associated end and immediately thereafter alternatingly first passing over and then crossing between the associated cross-threads of said cross-thread pairs; and, (f) said seam loops being aligned for permitting receipt of a slip-in joining means.

2. The assembly of claim 1, wherein:

(a) a filler thread extends through each seam loop and first loop generally parallel to the associated cross-threads.

3. The assembly of claim 2, wherein:

(a) each filler thread is engaged with a portion of the first loops.

4. The assembly of claim 1, wherein:

(a) each cross thread is a monofilament.

5. A papermaking machine felt, consisting essentially of:

(a) a plurality of spaced first and second cross-threads, said cross threads are longitudinally spaced and each first cross-thread is laterally spaced from a second cross-thread for thereby defining a plurality of cross-thread pairs;

(b) an end two of said cross-thread pairs define first and second fabric ends;

(c) a plurality of first and second alternatingly disposed lengthwise threads bind said cross threads into a fabric;

(d) each fabric end has a plurality of first loops formed by the first lengthwise threads, each first loop comprising one of the first lengthwise threads extending over the threads of the cross-thread pair at the associated fabric end and immediately thereafter said one of the first lengthwise threads extending back into the fabric and alternatingly first crossing between and then passing over the associated cross-threads of said cross-thread pairs;

(e) each fabric end having a plurality of seam loops formed by the second lengthwise threads, each seam loop comprising one of the second lengthwise threads extending beyond the associated fabric end and immediately thereafter each said one of the second lengthwise threads extending back into the fabric and between but not crossing between the cross-threads of the cross-thread pair at the associated end and immediately thereafter alternatingly first passing over and then crossing between the associated cross-thread pairs;

(f) said seam loops of said first and second ends are aligned; and, (g) a slip-in wire extends through said aligned seam loops and thereby joins said ends.

6. The felt of claim 5, wherein:

(a) a filler thread extends through each seam and first loop at the fabric ends generally parallel to the associated cross-threads.

7. The felt of claim 6, wherein:

(a) each filler thread is engaged with a portion of the associated first loops.

8. The felt of claim 5, wherein:

(a) each cross-thread is a monofilament.

* * * * *